United States Patent [19]

Skopek

[11] Patent Number: 4,745,694

[45] Date of Patent: May 24, 1988

[54] SEAM BOARD PACK

[76] Inventor: Elizabeth C. Skopek, 7837 Cahill Rd., Manlius, N.Y. 13104

[21] Appl. No.: 916,323

[22] Filed: Oct. 7, 1986

[51] Int. Cl.[4] ..... D06F 81/08

[52] U.S. Cl. ..... 38/103

[58] Field of Search ..... 38/103, 104

[56] References Cited

U.S. PATENT DOCUMENTS

| | | | |
|---|---|---|---|
| 36,684 | 10/1862 | Wilson | 38/103 |
| 57,170 | 8/1866 | Mort | 38/103 |
| 347,853 | 8/1886 | Whitman | 38/103 |
| 382,170 | 5/1888 | Liberoth | 38/103 |
| 430,509 | 6/1890 | Brown | 38/103 |
| 454,477 | 6/1891 | Hibler | 38/103 |
| 580,017 | 4/1897 | Sutton et al. | 38/103 |
| 627,648 | 6/1899 | Lockard | 38/103 |
| 1,228,869 | 6/1917 | Anderson | 38/103 |
| 2,314,498 | 3/1943 | Hoagland | 38/103 X |

*Primary Examiner*—Louis K. Rimrodt

*Attorney, Agent, or Firm*—Nies, Webner, Kurz & Bergert

[57] ABSTRACT

A seam board pack consists of an elongate flat base, useable as a pounding board, having a central groove running lengthwise in its top. A plurality of upstanding flat seam boards are interchangably positioned in the slot. The seam boards have edges of various contours corresponding to the contours of the seams to be ironed flat.

5 Claims, 3 Drawing Sheets

SEAM BOARD PACK

The present invention relates to seam board packs for pressing open seams of the various shapes and contours normally found in garments, so as to provide flat seams of professional appearance and finish.

A particular object is the provision of a seam board pack including a base which is used both as a clapper or pounding block for flattening seams and setting contours and as a support for mounting interchangable seam boards of various contours, providing back-up surfaces against which seams are ironed. In most instances the contour boards are mounted on the base support so that they extend upwardly in vertical planes. The engagement of the contour boards with the base is sufficiently firm that the base may constitute a stand to support the contour boards without wobbling or tipping.

Thus it is a further object of the present invention to provide a set of hardwood pressing tools for the seamstress or home sewer which is simpler, more convenient and versatile than those previously available.

These and other objects will be apparent from the following specification and drawings, in which.

Figure 1:
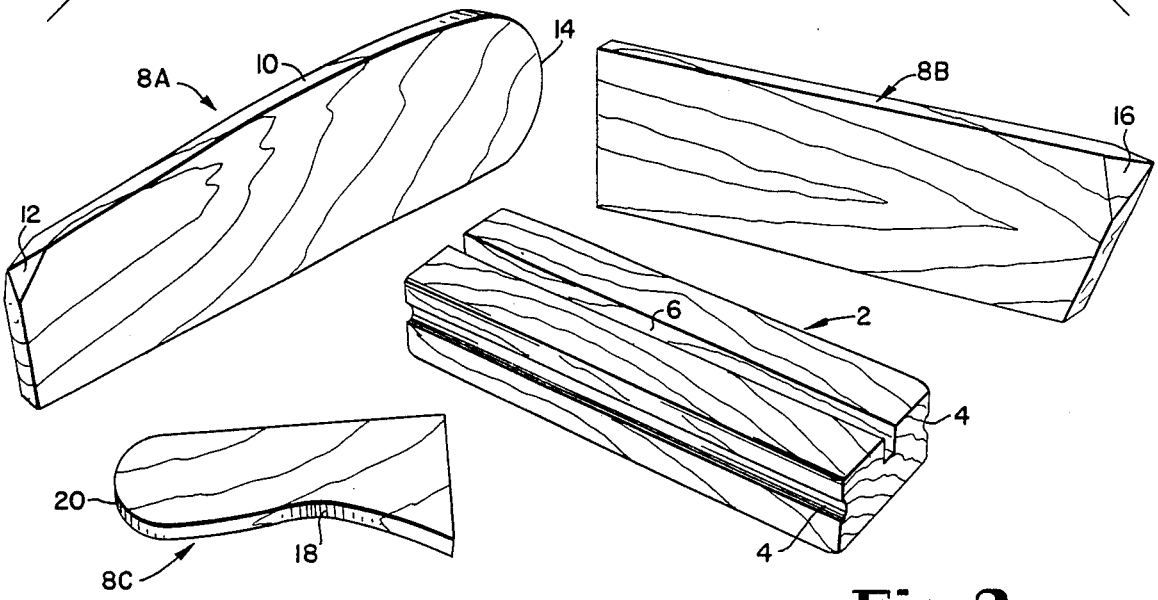
FIG. 1 is a perspective view of one of the seam boards mounted on the clapper board.

Referring now to the drawings, in which like reference numerals denote similar elements, the clapper and base 2 is essentially an oblong block having finger grooves 4 running along opposite sides for facilitating manual grasping of the clapper, and a central longtitudinal groove 6 extending lengthwise of the top of the clapper. Typically the clapper or base 2 measures 9"×2 ¾"×1¾", the central slot or groove 6 being approximately ½" in width and ¾" deep. By itself the clapper is used for pounding seams and setting creases.

Figure 2:
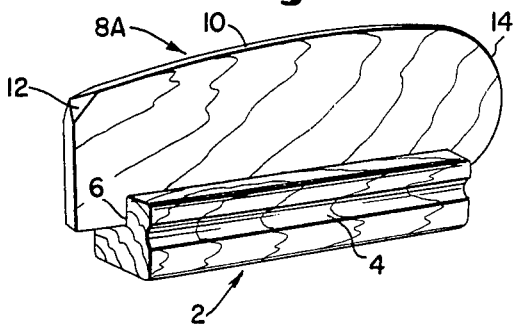
FIG. 2 is a perspective view of one of the seam boards mounted on the clapper board.
Figure 3:
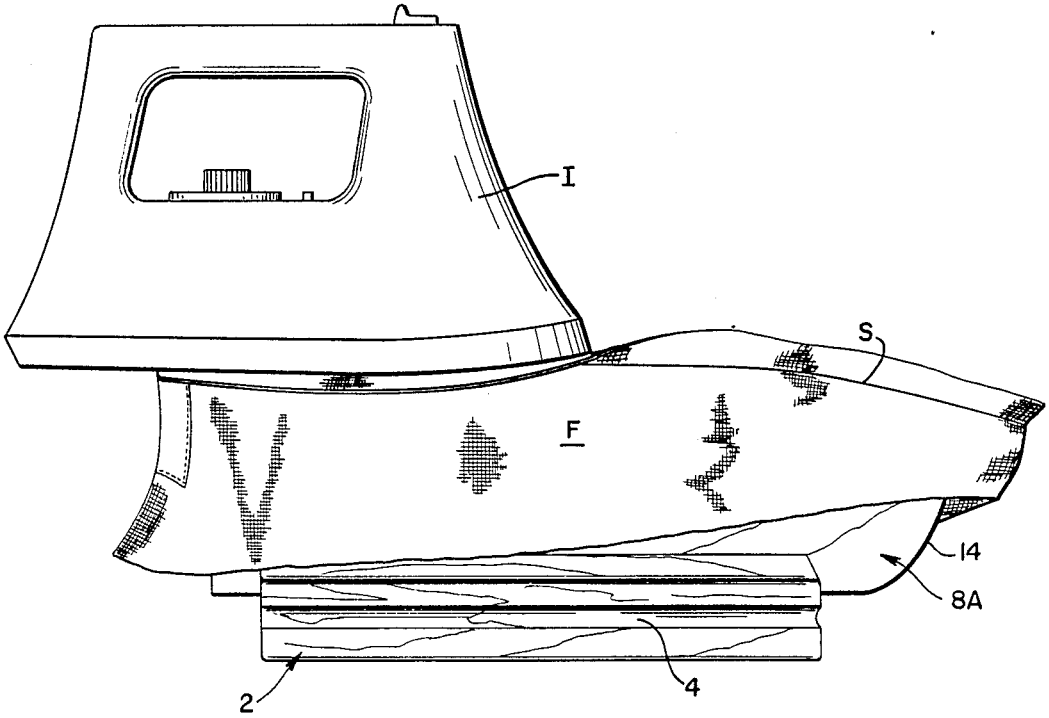
FIG. 3 is a side elevation of a seam board shown in FIG. 2 as typically used as a back-up for ironing elongate straight seams with a curved end portion.
Figure 4:
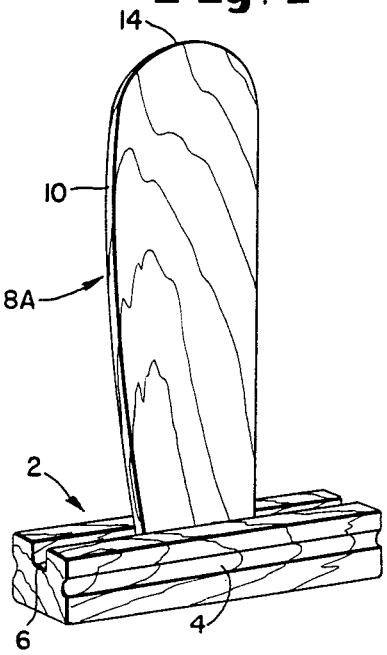
FIGS. 4–10 are views illustrating the various configurations of pressing surfaces effected by varying the assembly of the components of the seam board pack to accommodate the many differently shaped seams encountered in garment construction.

Seam board 8A is typically 12" long, has a width of 4" and a thickness of ½" so that it may be received in the groove 6 in the clapper base 2. Seam board 8A has an inclined top edge 10, a tapered end point 12 at one end, the other end defining a large curve 14. When used horizontally, as shown in FIGS. 2 and 3, seam board 8A is excellent for lapel seams, rounded collar seams, etc. When used vertically, as shown in FIGS. 4 and 5, the large curve provides a surface which may be used for pressing curved facings and princess seaming, etc.

Figure 6:
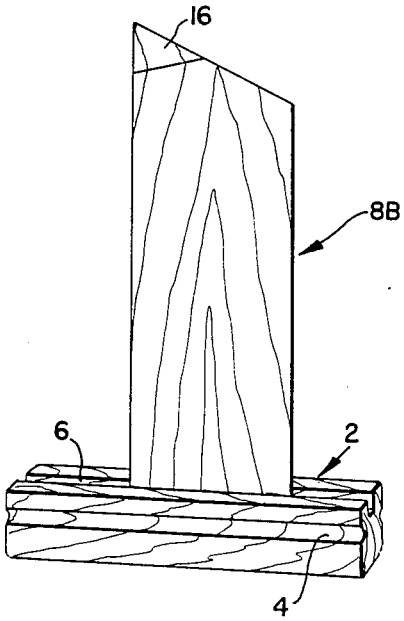
Figure 7:
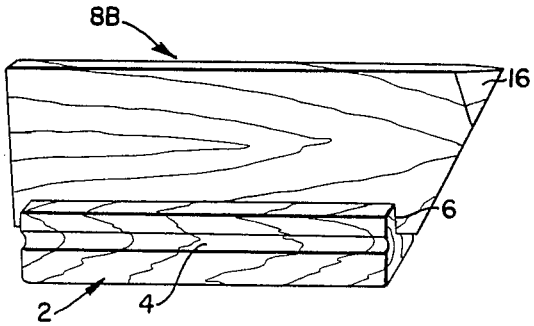
Figure 8:
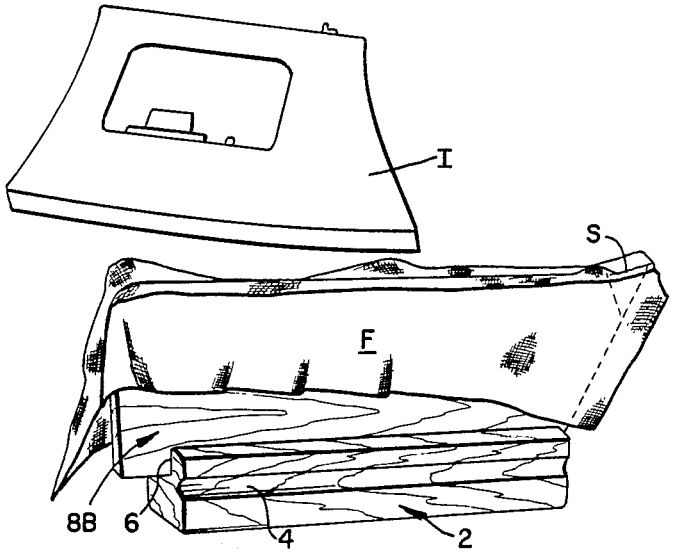

Seam board 8B is essentially straight with parallel upper and lower edges terminating at one end and at tapered end point 16. Typically seam board 8B is 12" long, 4" wide and ½" thick. When installed horizontally as shown in FIGS. 7 and 8, it may be used to press straight seams leading to a point for example, collars and cuffs. It may also be disposed vertically as shown in FIG. 6 with its tapered end point 16 facing upwardly in which position it will accommodate even more situations.

Figure 9:
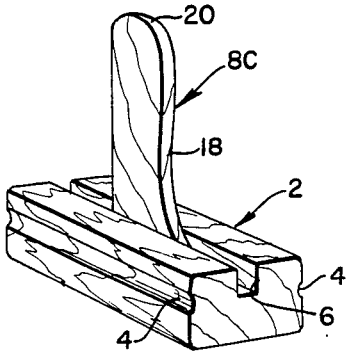
Figure 10:
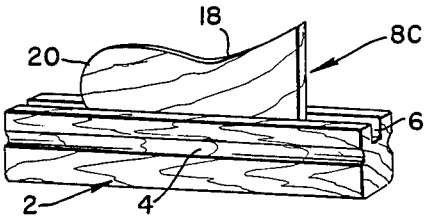

Seam board 8C which typically measures 5½"×3" and again is ½" in thickness to permit its accommodation in the groove 6 in the clapper, provides both a concave edge 18 and a convex edge 20 and is useful in pressing a variety of smaller seams and details such as Peter Pan collars. To provide maximum flexibility of use it may be installed either as shown in FIG. 9 or 10.

Figure 5:
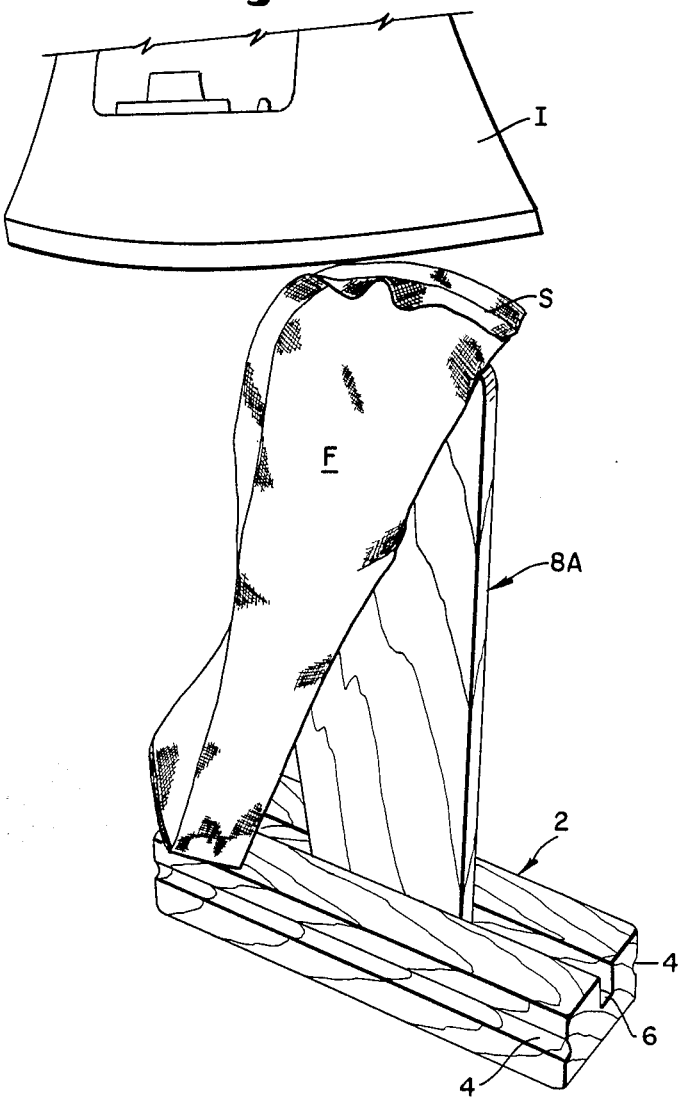

FIGS. 3, 5 and 8 illustrate the seam board pack in various configurations in actual use. As shown, a fabric F, having a seam S, is fitted over an edge of the seam board with the seam inside out and the seam is then ironed flat with a conventional iron I.

Because of the variety of sizes and shapes and the variety of modes of assembly of the components of the seam board pack, it will accommodate all of the basic seam shapes normally encountered in the construction of contemporary garments. At the same time it includes a very necessary tool, the clapper.

It also affords stability and ease of handling, and, regardless of the assembled position of the components provides an exposed working contour which is freely accessible without interference with other portions of the assembled unit. All of the components of the seam board pack are of uncomplicated mechanical construction and are unencumbered by design features or elements not associated with the pressing function, such as mechanical features to accommodate storage of the units incorporated in certain prior units.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A seam board assembly comprising a generally oblong block having opposite side surfaces and flat top and bottom surfaces, finger grooves formed in said side surfaces running lengthwise of said block and spaced from said top and bottom surfaces, a slot in said top surface of said block formed centrally thereof and extending along at least a substantial portion of the length of said block, and a plurality of seam boards each adapted to be removably received in said slot and each said seam board having flat opposite side portions engaging the side surfaces of said slot and a straight edge portion supported on the base of said slot, and each said seam board having at least one additional edge portion conforming to the shape of the seam to be ironed.

2. The combination claimed in claim 1, said additional edge portion being substantially straight.

3. The combination claimed in claim 1, one of said seam boards being tapered at one end of said additional edge portion and providing a back-up for ironing seams terminating in a pointed end.

4. The combination claimed in claim 1, said additional edge portion being convexly curved along one part of its length and concavely curved along another portion of its length whereby to conform selectively to concave and convex seams.

5. The combination according to claim 1 wherein certain of said seam boards have an additional straight edge for reception in said slot to permit positioning of said seam board on said block in a variety of positions.

* * * * *